US005955709A

United States Patent [19]

Traktovenko et al.

[11] Patent Number: 5,955,709

[45] Date of Patent: Sep. 21, 1999

[54] ELEVATOR CONTROL SYSTEM FEATURING ALL-ELECTROMAGNET VIBRATION AND CENTERING ELEVATOR CAR CONTROLLER FOR COUPLING A ROLLER ARRANGED ON A PIVOT ARM TO A GUIDE RAIL

[75] Inventors: Boris Traktovenko; Clement A. Skalski, both of Avon, Conn.

[73] Assignee: Otis Elevator Company, Farmington, Conn.

[21] Appl. No.: 08/989,448

[22] Filed: Dec. 12, 1997

Related U.S. Application Data

[63] Continuation-in-part of application No. 08/688,918, Jul. 31, 1996.

[51] Int. Cl.[6] ..... B66B 1/34

[52] U.S. Cl. ..... 187/292; 187/410

[58] Field of Search ..... 187/292, 393, 187/394, 409, 410

[56] References Cited

U.S. PATENT DOCUMENTS

| | | | |
|---|---|---|---|
| 3,180,280 | 4/1965 | Kuch et al. | 104/245 |
| 4,750,590 | 6/1988 | Otala | 187/95 |
| 4,754,849 | 7/1988 | Ando | 187/95 |
| 5,020,639 | 6/1991 | Michel | 187/1 R |

(List continued on next page.)

FOREIGN PATENT DOCUMENTS

| | | | |
|---|---|---|---|
| 0033184 | 8/1981 | European Pat. Off. | B66B 7/04 |
| 16090 | 2/1965 | Germany | 187/410 |
| 323185 | 1/1991 | Japan | B66B 11/02 |
| 33884 | 1/1991 | Japan | B66B 7/06 |
| 351279 | 3/1991 | Japan | B66B 5/02 |
| 351280 | 3/1991 | Japan | B66B 5/02 |
| 351281 | 3/1991 | Japan | B66B 5/02 |
| 3115076 | 5/1991 | Japan | B66B 1/06 |
| 5338956 | 12/1993 | Japan | 187/410 |
| 710418 | 1/1995 | Japan | B66B 7/04 |
| 72457 | 1/1995 | Japan | B66B 7/04 |
| 769541 | 3/1995 | Japan | B66B 1/06 |
| 8133627 | 5/1996 | Japan | B66B 11/02 |
| 981173 | 12/1982 | U.S.S.R. | 187/410 |
| 2262166 | 6/1993 | United Kingdom | B66B 7/02 |
| 2262932 | 7/1993 | United Kingdom | B66B 7/02 |

OTHER PUBLICATIONS

IECON '94, IEEE, Bologna, Italy, Sep. 5–9, 1994 "Attitude Control System of a Super–high Speed Elevator Car Based On Magnetic Guides", H. Inaba et al, pp. 1–6.

"Patent Abstracts of Japan," Application No. 64–252321, Masaaki Kagami, "Control Device For Elevator" Sep. 29, 1989.

"Patent Abstracts of Japan," Application No. 64–184769, Masato Kagami, Damping Device For Rolling of Elevator Jul. 19, 1989.

"Patent Abstracts of Japan," Application No. 64–182509, Masaaki Kagami, "Damping Device For Suspended Streak Body" Jul. 17, 1989

"Patent Abstracts of Japan," Application No. 64–132549, Masaaki Kagami, "Elevator" May 29, 1989.

"Patent Abstracts of Japan," Application No. 64–156883, Masaaki Kagami, "Vibration–Damping Device For Elevator" Jun. 21, 1989.

"Patent Abstracts of Japan," Application No. 4–154590, Akira Osada, "Elevator Guide Device" Jun. 15, 1992.

*Primary Examiner*—Jonathan Salata

[57] ABSTRACT

An elevator control system has a roller guide assembly comprising a plurality of rollers arranged in a cluster having at least one roller connected thereto for coupling an elevator car to a guide rail mounted on an elevator hoistway wall. The roller guide assembly comprises a pivot arm for pivoting on a horizontal pivot axis in relation to a longitudinal axis of the guide rail. The elevator control system features one or more electromagnet actuators for providing both vibration and centering control and without any solenoid for providing centering control.

9 Claims, 3 Drawing Sheets

U.S. PATENT DOCUMENTS

| | | | |
|---|---|---|---|
| 5,027,925 | 7/1991 | Kahkipuro | 187/115 |
| 5,086,882 | 2/1992 | Sugahara et al. | 187/95 |
| 5,117,946 | 6/1992 | Traktovenko et al. | 187/95 |
| 5,193,651 | 3/1993 | Shigeta et al. | 187/95 |
| 5,294,757 | 3/1994 | Skalski et al. | 187/115 |
| 5,304,751 | 4/1994 | Skalski et al. | 187/115 |
| 5,308,938 | 5/1994 | Roberts et al. | 187/115 |
| 5,321,217 | 6/1994 | Traktovenko et al. | 187/115 |
| 5,322,144 | 6/1994 | Skalski et al. | 187/115 |
| 5,329,077 | 7/1994 | Skalski et al. | 187/133 |
| 5,367,132 | 11/1994 | Skalski et al. | 187/393 |
| 5,373,123 | 12/1994 | Skalski | 187/393 |
| 5,379,864 | 1/1995 | Colby | 187/393 |
| 5,400,872 | 3/1995 | Skalski et al. | 187/393 |
| 5,439,075 | 8/1995 | Skalski et al. | 187/410 |
| 5,524,730 | 6/1996 | Roberts | 187/292 |
| 5,535,853 | 7/1996 | Skalski | 187/410 |
| 5,544,721 | 8/1996 | Roberts | 187/394 |

FIG.4
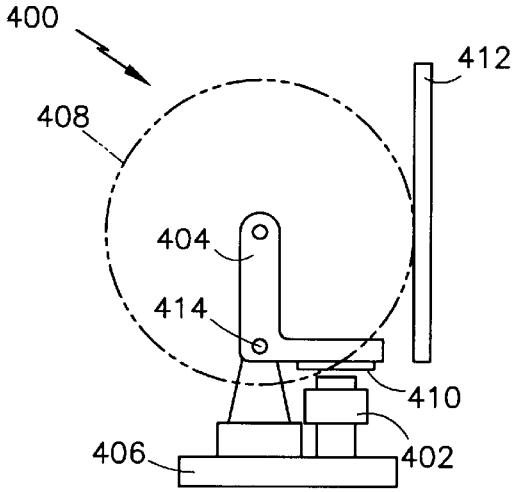
FIG.5
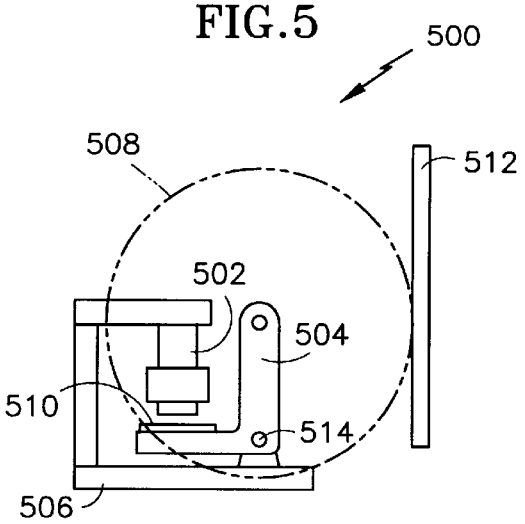
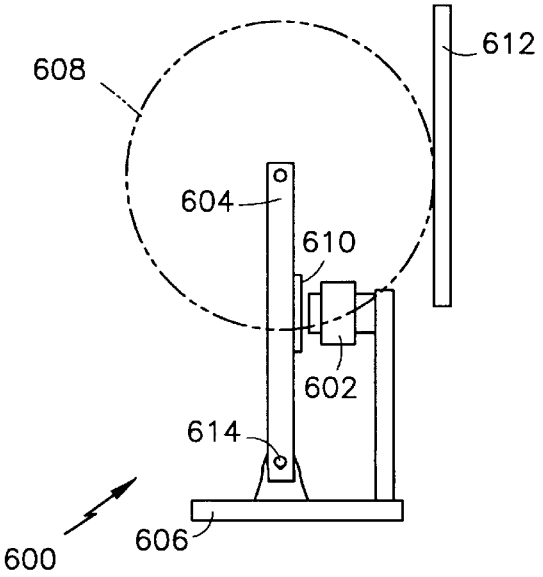
FIG.6
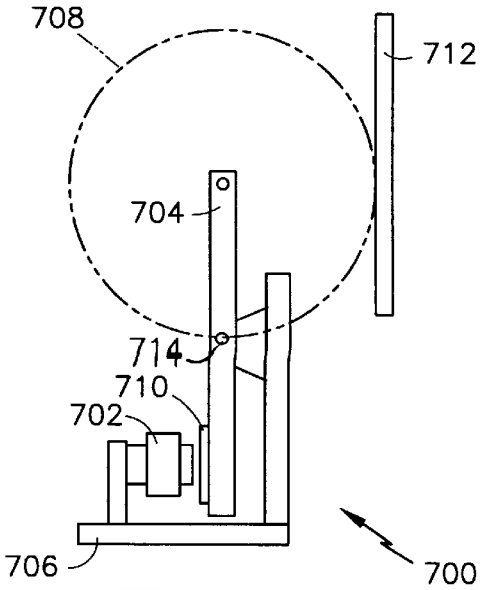
FIG.7

ELEVATOR CONTROL SYSTEM FEATURING ALL-ELECTROMAGNET VIBRATION AND CENTERING ELEVATOR CAR CONTROLLER FOR COUPLING A ROLLER ARRANGED ON A PIVOT ARM TO A GUIDE RAIL

CROSS REFERENCE TO A RELATED APPLICATION

This is a continuation-in-part claiming benefit under 35 USC §120 to co-owned, pending U.S. patent application Ser. No. 08/688,918, filed Jul. 31, 1996.

BACKGROUND OF THE INVENTION

1. Technical Field

This invention relates to an elevator system and, more particularly, to an elevator system having an active roller guide (ARG).

2. Discussion of Related Art

U.S. Pat. No. 5,810,120, shows and describes an elevator control system for active roller guides having front-to-back rollers arranged on horizontal pivots, having electromagnets for vibration control and having solenoids for centering control.

FIG. 1 of the present application shows the active roller guide system shown in FIG. 2 of U.S. Pat. No. 5,810,120. The reference numerals used herein are the same as that used in U.S. patent application Ser. No. 08/741,751, and reference is made thereto as background for a more detailed description thereof.

In summary, FIG. 1 herein shows a simplified diagram of a roller guide assembly generally indicated as 40 for the purpose of discussing the basic operation of each roller guide assembly. As shown, the actuator assembly 40 includes a solenoid and magnet base 42 having a pivot support 44 mounted thereon. The actuator assembly 40 also includes a pivot bar 46 mounted on the pivot support 44 for pivoting about a pivot axis 48, and a roller arm 50 mounted on the pivot bar 46 with a roller axis 52. The actuator assembly 40 also includes a solenoid 54, a spring 56, an electromagnet 58 and a ferromagnetic plate 60. The actuator assembly 40 responds to control signals from the elevator car controller 20 that is in turn responsive to sensed elevator car signals. The control signals include a solenoid centering elevator car control signal on a line 61*a* to the solenoid 54 to control the centering or coarse position of an elevator car (not shown) in relation to guide rails (not shown) of an elevator hoistway (not shown), and an electromagnet vibration elevator car control signal on a line 61*b* to the electromagnet 58 to control the vibration and/or the fine position of the elevator car via rollers in relation to the guide rails of the elevator hoistway.

One of the disadvantages of using solenoids for centering control is that solenoids have a mechanical component to them that results in undesirable clacking and/or wearing; moreover, solenoids increase the parts count of the overall elevator design, significantly increase technical risk, require more adjustment, and generally decrease the robustness of the elevator control system.

U.S. Pat. No. 5,810,120 does not show or describe an elevator system having an active roller guide system with either front-to-back rollers arranged on horizontal pivots or the use of all electromagnets for both vibration and centering elevator car control as disclosed below. The subject matter of U.S. Pat. No. 5,810,120 is assigned to the assignee of the present application, and hereby incorporated by reference.

SUMMARY OF INVENTION

The present invention provides an elevator control system having a roller guide assembly comprising a plurality of rollers arranged in a cluster having at least one roller connected thereto for coupling an elevator car to a guide rail mounted on an elevator hoistway wall wherein the roller guide assembly includes a pivot arm for pivoting on a horizontal pivot axis in relation to a longitudinal axis of the guide rail.

The elevator control system features electromagnets for providing both vibration and centering control and without any electromechanical actuator such as a solenoid for providing centering control. In other words, the elevator control system of the present invention includes only one or more electromagnet actuators for providing both vibration and centering control. In that case, there isn't any need for any solenoid or solenoids for providing centering control.

In further accord with the present invention, the elevator control system includes a controller for providing electromagnet actuator force control signals to the electromagnet actuator to rotate the pivot arm about the horizontal pivot axis and couple the elevator car and the guide rail.

In the present invention, the roller guide assembly may provide either front-to-back centering and vibration control, side-to-side centering and vibration control, or a combination thereof, for exclusively controlling the movement of the elevator car in relation to the guide rail by means of electromagnets.

The present invention also features an all-electromagnet vibration and centering elevator car controller that may be suitably adaptable using control techniques relating to electromagnet control described in U.S. patent application Ser. No. 08/688,918, the parent of the present application.

One advantage of eliminating the need for solenoids for centering control is to eliminate the undesirable clacking or wearing of the solenoids, to minimize the parts count of the overall design, to significantly decrease the technical risk and time needed to design elevator systems having solenoids, and to minimize the adjustments and decrease the amount of things that can go wrong in elevator systems having solenoids.

BRIEF DESCRIPTION OF THE DRAWING

For a fuller understanding of the nature and objects of the invention, reference should be made to the following detailed description taken in connection with the accompanying drawings, not in scale, in which:

FIG. 4 shows a simplified actuator design of an embodiment of the subject matter of the present invention in FIG. 3 without a biasing spring.

FIG. 5 shows a simplified actuator design of another embodiment of the subject matter of the present invention.

FIG. 6 shows a simplified actuator design of still another embodiment of the subject matter of the present invention.

FIG. 7 shows a simplified actuator design of still another embodiment of the subject matter of the present invention.

DETAILED DESCRIPTION OF PREFERRED EMBODIMENTS

Figure 2:
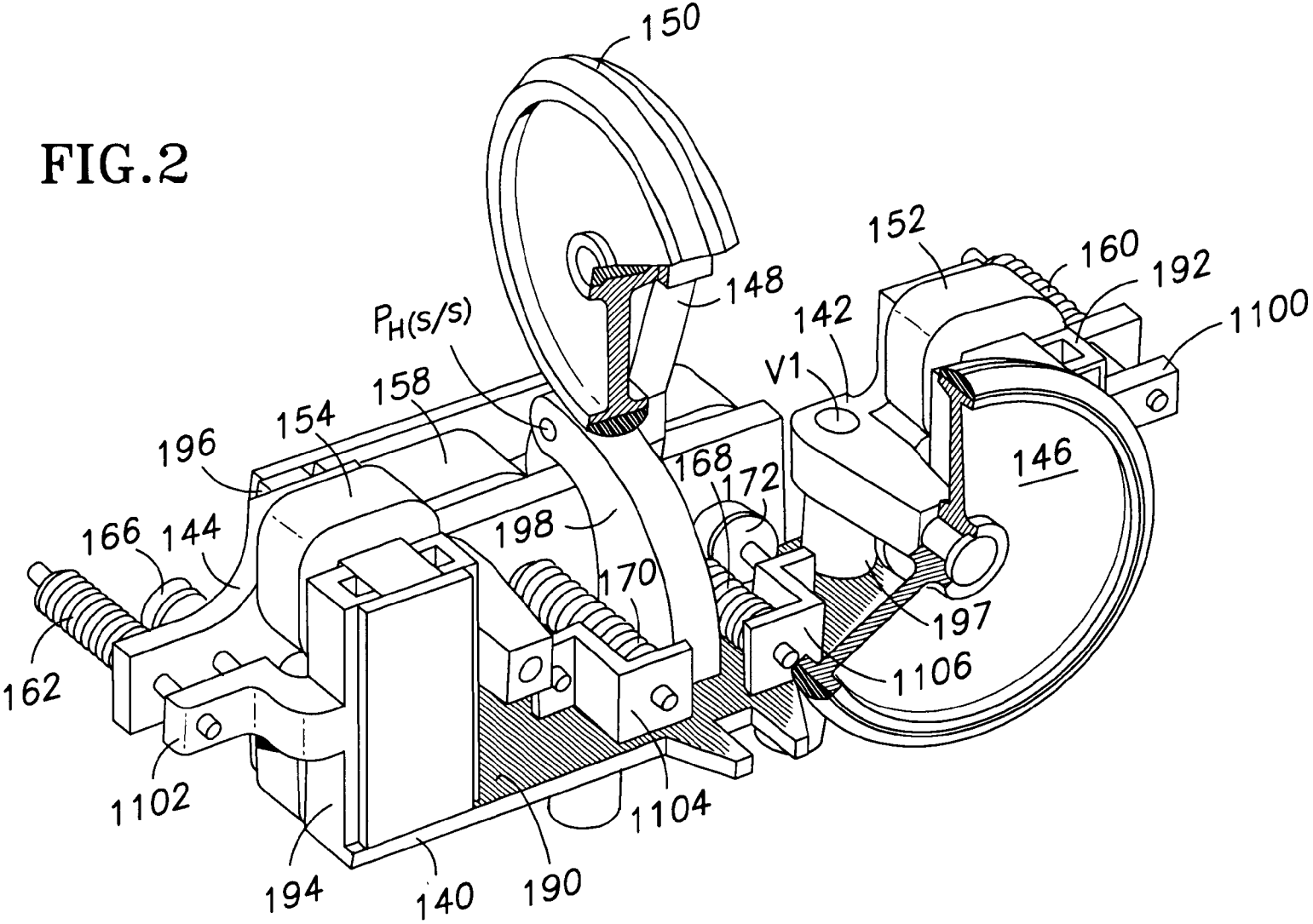
FIG. 2 shows the active roller guide system similar to that shown in FIG. 2 of U.S. patent application Ser. No. 08/688,918.

U.S. patent application Ser. No. 08/688,918 shows and describes an elevator system for an active roller guide having front-to-back rollers arranged on vertical pivots and having electromagnets for both centering and vibration control. FIG. 2 of the present application shows the active roller guide system similar to that shown in FIG. 2 of U.S. patent application Ser. No. 08/688,918.

In effect, U.S. patent application Ser. No 08/688,918 shows and describes how to use large electromagnets in active roller guide systems using vertical pivots for the front-to-back rollers. This design is advantageous because of compact packaging, rigidity, and the ability to leverage the force of the magnet. The leveraging concept permits the use of ARG systems operating on T-rails where use of magnetic guidance would be impossible without major improvements to the guide rails. The ARG system is very useful in modernizing elevators having poorly aligned rails.

The reference numerals used in FIG. 2 herein are the same as that used in FIG. 2 of U.S. patent application Ser. No. 08/688,918 with the addition of a one (i.e. "1") as a prefix to the reference numeral (e.g. "40" becomes—140, while "100" becomes—1100—). The ARG assembly includes the following: an assembly stand 140; front-to-back (hereinafter "F/B") pivot arms 142, 144 having respective vertical pivots V1, (V2 not shown); a F/B roller 146 (the other front-to-back roller is not shown); a side-to-side (hereinafter "S/S") pivot arm 148 using horizontal pivot $P_{H(S/S)}$; a S/S roller 150; F/B electromagnets 152, 154; a S/S electromagnet 158, F/B compression springs 160, 162; F/B snubbers (stops) to limit motion only snubber 166 is shown; S/S compression springs 168, 170; S/S snubbers 172 (the other a S/S snubber is not shown); a base plate 190; F/B electromagnet support 192, 194; S/S electromagnet supports 196; F/B arm support 197 (the other F/B arm support is not shown), a S/S arm support 198; F/B compression spring and snubber supports 1100, 1102; and S/S spring and snubber supports 1104, 1106. Reference is made to U.S. patent application Ser. No. 08/688,918 for a more detailed description thereof.

Figure 3:
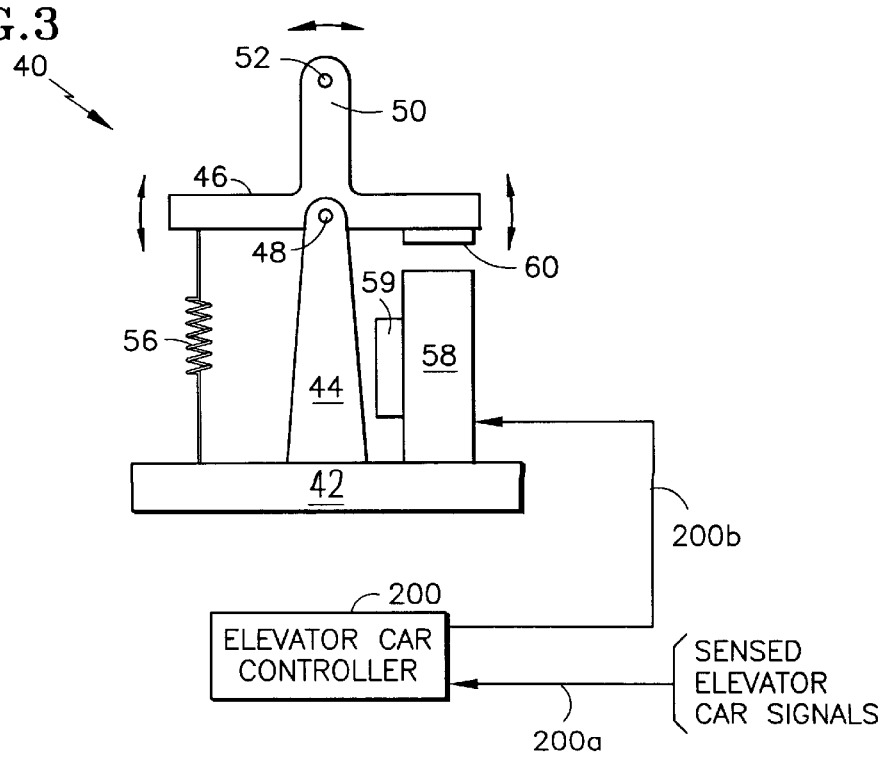
FIG. 3 shows a simplified actuator design of one embodiment of the subject matter of the present invention.

FIG. 3 shows a simplified diagram of the present invention. The reference numerals used in FIG. 3 are similar to those used in FIGS. 1–2 of U.S. Pat. No. 5,810,120 where the reference numerals correspond with one another.

In FIG. 3, according to the present invention, no solenoid or solenoids are used for centering control. Reference is made to FIGS. 3–9 of U.S. Pat. No. 5,810,120 for a detailed drawing and description of a front-to-back or side-to-side roller guide assembly with solenoids. However, according to the present invention, the solenoids and related structure used for centering control are eliminated from that shown in FIGS. 3–9 of U.S. Pat. No. 5,810,120.

Figure 1:
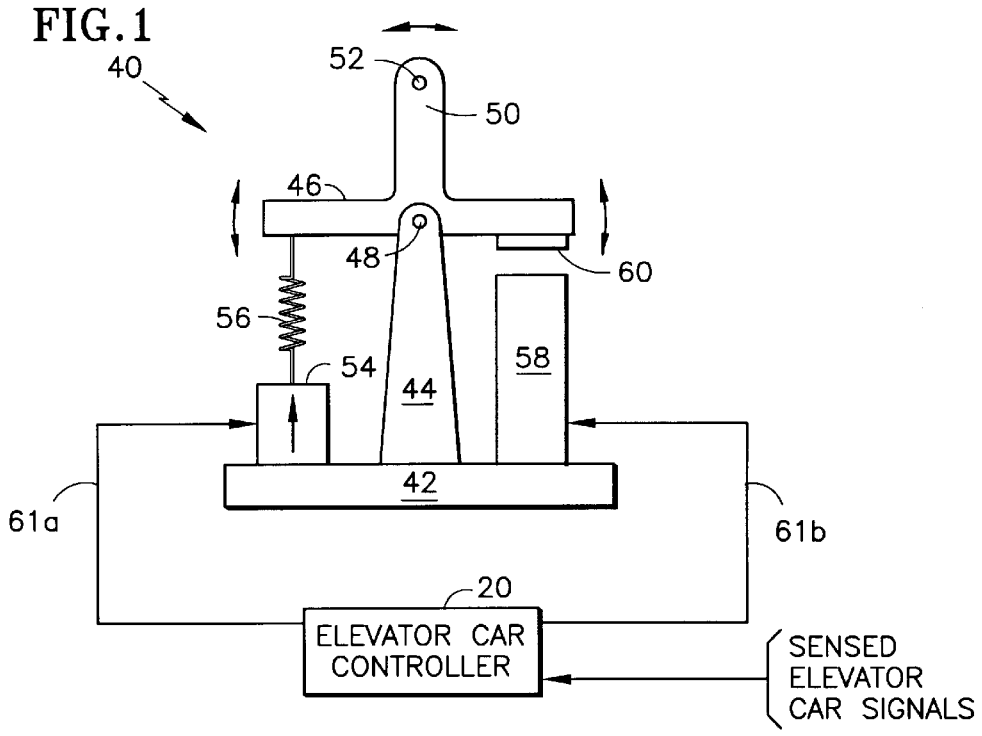
FIG. 1 shows an active roller guide system similar to that shown in FIG. 2 of U.S. patent application Ser. No. 08/741,751.

In addition, according to the present invention, an all-electromagnet vibration and centering elevator car controller 200 for all-electromagnet vibration and centering control is substituted for the elevator car controller 20 in FIG. 1 above. The all-electromagnet vibration and centering elevator car controller 200 responds to sensed elevator car signals **200*a*, for providing electromagnet actuator force control signals 200*b* to the electromagnet actuator 58 to rotate the pivot arm (bar) 46 about the horizontal pivot axis 48** and couple the elevator car and the guide rail. The present invention uses all electromagnets for either front-to-back vibration and centering control, side-to-side vibration and centering control, or front-to-back and side-to-side vibration and centering control.

As any person skilled in the elevator art would appreciate, the all-electromagnet vibration and centering elevator car controller 200 may be implemented in either hardware or software. For example, in a typical software embodiment, a microprocessor architecture could be used including a microprocessor, Random Access Memory (RAM), Read Only Memory (ROM), input/output circuits, with data, address and control busses connecting the aforementioned. Moreover, any person skilled in the elevator art would appreciate that the elevator car controller in U.S. Pat. No. 5,810,120 may be modified to eliminate the solenoid centering control signals in order to substitute all-electromagnet vibration and centering control signals. U.S. patent application Ser. No. 08/858,001 shows and describes a dual magnet controller for an ARG system that may be used in U.S. Pat. No. 5,810,120. U.S. patent application Ser. No. 08/858,001 is assigned to the assignee of the present application and hereby incorporated by reference. The scope of the invention is not intended to be limited to any particular embodiment of the all-electromagnet vibration and centering elevator car controller 200, however.

As shown in FIG. 3, a biasing compression spring 56 provides at least one coil spring force for controlling the position of the elevator car in relation to the guide rails of the elevator hoistway. The biasing compression spring 56 may be used together with the electromagnet 58 for improved front-to-back control, improved side-to-side control, or a combination thereof. As also shown in FIG. 3, the actuator assembly 40 includes a heat sink 59 for dissipating heat generated thereby.

Other designs using horizontal pivots are also presented below. Each horizontal pivot design described in the present application is used with its mirror image to form a complete actuator that supplies bi-directional force for both centering and vibration control.

All of the horizontal pivot designs permit adjustment of the lever arm mechanical advantage. Typically, it is desirable to have the motion at the magnet amplified by the lever. This minimizes the airgap at the magnet while decreasing the power requirements for a given force at the roller. This type of scaling is advantageous to meet roller travel requirements without excessive current densities.

For example, FIG. 4 shows a simplified actuator design for another embodiment of the subject matter of the present invention without the biasing spring 56 of FIG. 3 and a lever slightly different that the pivot bar 46 in FIG. 3. In FIG. 4, the roller guide assembly generally indicated as 400 includes an electromagnet 402, a lever 404, a stand 406, a roller 408, a magnet keeper (flux return path) 410, a rail 412 and a pivot axis 414.

FIG. 5 shows a simplified actuator design of still another embodiment of the present invention. In FIG. 5, the roller guide assembly generally indicated as 500 includes an electromagnet 502, a lever 504, a stand 506, a roller 508, a magnet keeper (flux return path) 510, a rail 512 and a pivot axis 514. The embodiment in FIG. 5 provides an effective way of avoiding a problem with space available for the magnet in between the pivot and the rail.

FIG. 6 shows a simplified actuator design of yet another embodiment of the subject matter of the present invention that is an alternative to the design of FIG. 4 but using a straight lever. In FIG. 6, the roller guide assembly generally indicated as 600 includes an electromagnet 602, a lever 604, a stand 606, a roller 608, a magnet keeper (flux return path) 610, a rail 612 and a pivot axis 614.

FIG. 7 shows a simplified actuator design of another embodiment of the present invention that is an alternative to the design of FIG. 5 but using a straight lever. In FIG. 7, the roller guide assembly generally indicated as 700 includes an electromagnet 702, a lever 704, a stand 706, a roller 708, a magnet keeper (flux return path) 710, a rail 712 and a pivot axis 714.

In essence, the present invention improves on the elevator system design of the subject matter shown and described in U.S. Pat. No. 5,810,120 by using only one or more electromagnet, for a roller, i.e. without any solenoids. The following design configuration is provided having double the offset load capacity of the elevator system design of the subject matter shown and described in U.S. patent application Ser. No. 08/741,751:

1. Total power=450 Watts maximum
2. The size of a robust front/back magnet is:
   a) height=90 millimeters
   b) width=228 millimeters
   c) depth=114 millimeters
3. The size of a robust side/side magnet is:
   a) height=112 millimeters
   b) width=286 millimeters
   c) depth=143 millimeters
4. Total magnet/solenoid weight=32.4 kilograms per roller cluster (3 rollers)
   a) front-to-back magnet weighs 8.2 kilograms (1400 Newtons)
   b) side-to-side magnet weighs 16 kilograms (2200 Newtons [larger airgap than f/b magnet])

Scope of the Invention

It is to be understood that the above-described arrangements are only illustrative of the application of the principles of the present invention. Numerous modifications and alternative arrangements may be devised by those skilled in the art without departing from the spirit and scope of the present invention, and appended claims are intended to cover such modifications and arrangements.

We claim:

1. A roller guide assembly comprising a plurality of rollers arranged in a cluster for coupling an elevator car to a guide rail mounted on an elevator hoistway wall, the roller guide assembly including an actuator for actuating a pivot arm for at least one roller for pivoting on a pivot axis in relation to a longitudinal axis of the guide rail, characterized in that the roller guide assembly includes only one or more electromagnet actuators for providing both vibration and centering control, each electromagnetic actuator thereby providing all of the force for pivoting a corresponding one of said pivot arms about a related one of said pivots.

2. A roller guide assembly according to claim 1, characterized in that the one or more electromagnet actuators respond to an electromagnet actuator force control signal from an all-electromagnet vibration and centering elevator car controller, for rotating the pivot arm about the pivot axis and coupling the elevator car and the guide rail.

3. A roller guide assembly according to claim 1, characterized in that the roller guide assembly is for providing front-to-back centering and vibration control movement of the elevator car in relation to the guide rail.

4. A roller guide assembly according to claim 1, characterized in that said roller guide assembly is for providing side-to-side centering and vibration control of the elevator car in relation to the guide rail.

5. A roller guide assembly according to claim 1, characterized in that the roller guide assembly is for providing front-to-back and side-to-side centering and vibration control movement of the elevator car in relation to the guide rail.

6. A roller guide assembly according to claim 1, characterized in that the electromagnet actuator includes a heat sink for dissipating heat generated thereby.

7. A roller guide assembly according to claim 1, characterized in that the pivot axis is horizontal in relation to the longitudinal axis of the guide rail.

8. A roller guide assembly according to claim 1, characterized in that the pivot axis is vertical in relation to the longitudinal axis of the guide rail.

9. A roller guide assembly according to claim 1, characterized in that the pivot axis is horizontal in relation to the longitudinal axis of the guide rail.

* * * * *